US005126621A

United States Patent [19]

Morton et al.

[11] Patent Number: 5,126,621

[45] Date of Patent: Jun. 30, 1992

[54] RUGGEDIZED FLASHLAMP EXHIBITING HIGH AVERAGE POWER AND LONG LIFE

[75] Inventors: Richard G. Morton; William J. Connally, both of San Diego, Calif.

[73] Assignee: Maxwell Laboratories, Inc., San Diego, Calif.

[21] Appl. No.: 645,372

[22] Filed: Jan. 24, 1991

[51] Int. Cl.[5] ..... H01J 17/18; H01J 9/18

[52] U.S. Cl. ..... 313/237; 313/623; 313/624; 313/625; 313/634; 445/26; 445/29; 445/33; 445/43; 439/612; 439/615

[58] Field of Search ..... 313/237, 623, 624, 634, 313/625; 439/612, 615, 638, 642; 445/26, 29, 33, 43; 372/61, 87, 109

[56] References Cited

U.S. PATENT DOCUMENTS

| | | | |
|---|---|---|---|
| 1,322,610 | 11/1919 | Pfanstiehl | 428/579 |
| 2,725,498 | 11/1955 | Storms et al. | 313/217 |
| 2,941,099 | 6/1960 | Picard et al. | 313/7 |
| 3,090,891 | 5/1963 | Folsom | 315/39.51 |
| 4,075,530 | 2/1978 | Furukubo et al. | 313/229 |
| 4,713,580 | 12/1987 | Schoene | 313/624 |

FOREIGN PATENT DOCUMENTS

| | | | |
|---|---|---|---|
| 1224631 | 3/1971 | United Kingdom | 439/612 |

*Primary Examiner*—Donald J. Yusko
*Assistant Examiner*—Diab Hamadi
*Attorney, Agent, or Firm*—Fitch, Even, Tabin & Flannery

[57] ABSTRACT

A flashlamp provides a ruggedized yet simple-to-manufacture construction capable of operating at high average output power over a long life. The flashlamp construction includes a glass tube (12) with an electrode assembly (24) detachably secured to each end. The electrode assembly includes an end cap (26) to which an electrode support (28) is attached, with a first end (32) of the electrode support protruding inside of the glass tube, and a second end (44) of the electrode support protruding outside of the glass tube. The electrode support (28) is made from a suitable electrical conductor. An electrode (34) is threaded onto the first end of the electrode support (28) without the use of brazing or other attachment techniques that might introduce impurities. An electrode lug (36) is attached to or near the second end of the electrode support, outside of the glass tube, and provides a means for making electrical contact with the electrode (34). The end cap includes threads (30) so as to engage corresponding threads (22) on the inside of an attachment ring (16). One attachment ring is secured and sealed to each end of the glass tube. The electrode assemblies are attached to each end of the glass tube by simply threading the end caps into the attachment rings. An indium washer (42) placed between the end cap and attachment ring effectuates a vacuum seal between the end cap and glass tube.

23 Claims, 2 Drawing Sheets

RUGGEDIZED FLASHLAMP EXHIBITING HIGH AVERAGE POWER AND LONG LIFE

BACKGROUND OF THE INVENTION

The present invention relates to flashlamps, and more particularly to a flashlamp that provides simple manufacturability, ruggedized operation, high average output power, and long life.

A flashlamp (sometimes referred to as a "flash tube") is a device that produces a brief burst of light because of the ionization of a gas. A flashlamp includes a glass tube (or other quartz envelope) filled with a gas, e.g., xenon, at low pressure, and two electrodes, one at each end of the tube. In some embodiments, the tube may be coiled to increase its length while minimizing its occupied volume, in order to provide a brighter flash. When a sufficiently high voltage is momentarily applied between the electrodes, the gas in the tube ionizes and produces a flash of light.

Advantageously, the flash of light produced by a flashlamp or flash tube may be controlled to occur at a precise instant of time, determined by when the voltage is applied to its electrodes. A flashlamp may thus be controlled to "flash" for a single flash, or for multiple flashes, at an irregular or periodic rate, which rate may be very rapid. Flashlamps are commonly used in strobe lights. Flashlamps are also frequently used in photography, and any other application where a bright burst of light is needed at a particular timed instant or interval. Flashlamps also find common use in processing facilities, e.g., to perform biological sterilization, as in a food processing facility. Flashlamps may also be used to cure some epoxies, and in ultraviolet photolithography.

One of the difficulties encountered with flashlamps of the prior art relates to maintaining a proper seal between the glass tube and the metal electrodes at each end of the tube. Flashlamps have thus fallen into two basic design categories: (1) those employing a "hard" glass to metal seal; and (2) those employing a soft solder glass to metal seal. The first type of flashlamp requires the skill of a glass blower, is extremely difficult to manufacture uniformly, and is inherently fragile. Further, this first type of flashlamp is unduly limited in its average power handling capability because the heat dissipated in the electrode must be extracted through the glass tube.

The second type of flashlamp is more "rugged" than the first (i.e., not as fragile), and offers somewhat improved average power handling capability because of additional thermal conductivity at the electrode ends where the solder seal is made. This additional thermal conductivity provides a thermal path through which much of the heat developed during operation of the lamp may be dissipated. Nonetheless, the second type of flashlamp, along with the first type of flashlamp, suffer from some common deficiencies. For example, it is not possible to clean the lamp, i.e., clean the inside of the glass tube or other quartz envelope, once the final sealing operation, e.g., welding or soldering, has taken place. Further, both types of design suffer from a serious design flaw that prevents optimum performance and long life. This flaw results because the electrodes must be brazed onto a suitable support stem. Such brazing causes contamination at the electrode. Hence, the electrode can never have the purity of the pristine electrode material. Disadvantageously, any contaminants present at the electrode, e.g., as introduced through brazing, are eventually manifest as deposits on the inside of the glass tube or other quartz envelope. Such deposits not only limit the amount of light that can be transmitted through the glass or quartz material (i.e., they cloud up the inside of the flashlamp), but they also adversely affect the thermal properties of the glass or quartz material, which eventually may cause the glass or quartz tube to break. In either event, the presence of any contaminants at the electrode has the effect of shortening the useful life of the flashlamp.

In view of the above deficiencies, it is evident that there is a need for a flashlamp that is easy to manufacture; provides improved thermal conductivity to allow higher average power dissipation therein; allows cleaning of the quartz envelope; and eliminates the need to braze the electrode to a support stem, thereby maintaining the purity of the electrode material and increasing the useful operating life of the flashlamp. The present invention advantageously addresses the above and other needs.

SUMMARY OF THE INVENTION

In accordance with one aspect of the present invention, a flashlamp is provided that is easy to manufacture and assemble. The flashlamp includes a glass tube, or other quartz envelope, made from, e.g., Suprasil. An electrode assembly is detachably secured to each end of the tube. The electrode assembly includes an end cap to which an electrode support is attached, with a first end of the electrode support protruding inside of the glass tube, and a second end of the electrode support protruding outside of the glass tube. The electrode support is made from a suitable electrical conductor, such as copper, nickel or titanium. A suitable electrode is threaded onto the first end of the electrode support without the use of brazing or other attachment techniques that might introduce impurities. A suitable electrode lug is attached to or near the second end of the electrode support, outside of the glass tube, and provides a convenient means for making electrical contact with the electrode. The end cap is threaded so as to engage corresponding threads on the inside of an attachment ring. One attachment ring is secured and sealed to each end of the glass tube by means of a soft seal. Hence, the electrode assemblies are attached to each end of the glass tube by simply threading the end caps into the attachment rings. An indium washer placed between the end cap and attachment ring effectuates a vacuum seal between the end cap and the glass tube.

In accordance with another aspect of the flashlamp herein disclosed, the attachment ring is secured and sealed to the ends of the glass tube through the use of a platinum coating that is plated or otherwise deposited around each end of the glass tube. This platinum coating interfaces between the attachment ring and the glass tube, and provides a base to which solder can be attached. Solder is then applied in conventional manner to effectuate a tight and secure, yet "soft", seal between the attachment ring and the platinum coating.

In accordance with yet another aspect of the invention, the electrode support is made from a hollow tube. A small fill hole is included near the first end of the electrode support of at least one of the electrode assemblies. This fill hole provides a convenient means for evacuating and inserting a desired gas into the flashlamp once its assembly is completed.

In accordance with still another aspect of the invention, the design of the flashlamp facilitates differing lengths of electrode support, thereby allowing a wide range of average powers to be realized. The average power dissipated by the flashlamp, in turn, determines its internal temperature, which internal temperature is an important operating parameter of the flashlamp.

One embodiment of the invention may be characterized as a flashlamp that includes: (1) a quartz envelope having a specified gas sealed therein; (2) electrode means detachably secured to the quartz envelope for making electrical contact with the gas, this electrode means including a pair of spaced apart electrodes inside of the quartz envelope, each electrode of the pair of electrodes being detachably connected to a first end of respective electrode supports without brazing or other contaminating bonding processes that introduce impurities at the electrode; and (3) means for making electrical contact with the electrode means from a location external to the quartz envelope.

Another embodiment of the invention may also be characterized as a flashlamp that comprises: (1) a transparent tube having first and second open ends; (2) first and second electrode assemblies detachably secured to the said first and second open ends, respectively, each of said first and second electrode assemblies including (a) an end cap, (b) a rigid electrode support attached to the end cap, the electrode support comprising an electrically conductive material, the electrode support passing through the end cap such that a first end protrudes from one side of the end cap, and a second end protrudes from the other side of the end cap, and (c) an electrode detachably secured to the first end of the electrode support without the use of brazing or other attachment techniques that create impurities at the electrode; (3) attachment means for detachably sealing the first and second electrode assemblies to the first and second open ends of the transparent tube, respectively, such that the electrode of each electrode assembly is inside of the transparent tube, and the second end of the electrode support is outside of the transparent tube; (4) a prescribed gas inside of the transparent tube; and (5) means for making electrical contact with the second end of the electrode support of the first and second electrode assemblies. In operation, an electrical potential is established between the electrodes of each electrode assembly of sufficient magnitude to momentarily ionize the gas, thereby causing a flash of light to be emitted.

Still further, the invention may be viewed as a method of assembling a flashlamp. Such method includes: (a) placing a platinum coating on an end of a quartz tube that is to be sealed; (b) soldering an attachment ring to the platinum coating, the attachment ring having threads for receiving a threaded end cap; (c) assembling an electrode assembly, the electrode assembly including a hollow electrode support secured to and passing through the end cap; (d) screwing the electrode assembly into the attachment ring; (e) injecting a gas into the quartz tube through the hollow electrode support; and (f) crimping an end of the electrode support external to the quartz tube, thereby sealing the gas within the quartz tube. Advantageously, the step of assembling the electrode assembly in accordance with this method includes: (c1) forming (drilling or otherwise placing) a hole through the center of the end cap; (c2) inserting the electrode support through the hole of the end cap so that it protrudes from both sides thereof, with the length of the electrode from the end cap to a first end being a prescribed distance; (c3) soldering the electrode support within the hole of the end cap so that the hole is sealed; and (c4) detachably securing an electrode to the first end of the electrode support.

It is a feature of the present invention to provide an improved flashlamp that is easy to manufacture, rugged in construction, and efficient to operate.

It is another feature of the invention to provide such a flashlamp that is capable of operating at high average power over a long life.

It is a further feature of the invention to provide a flashlamp that does not require brazing of the electrode to support structure.

It is an additional feature of the invention to provide a flashlamp that can be disassembled, when desired, e.g., for cleaning or recycling of parts.

Other advantageous features of the present invention include: (1) the use of an electrode assembly comprising an electrode support and an electrode, with the electrode being threaded onto the support member, thereby facilitating its assembly; (2) the use of a tube assembly adapted to detachably receive the electrode assembly in a way that allows the electrode assembly to be threaded into an attachment ring that is sealed to the quartz envelope (e.g., glass tube) by a soft solder seal, thereby further facilitating the flashlamp assembly; (3) the use of a platinum coating around the ends of the quartz envelope to facilitate making a soft solder seal between the attachment ring and the quartz envelope using conventional solder; and (4) the use of materials having differing thermal coefficients for the electrode support and the electrode so that when heated, as during normal operation of the flashlamp, the electrode becomes more tightly bonded to the electrode support, thereby assuring a good electrical contact.

Still an additional feature of the invention includes the use of indium to act as a vacuum seal between the electrode assembly and the attachment ring of the tube assembly.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
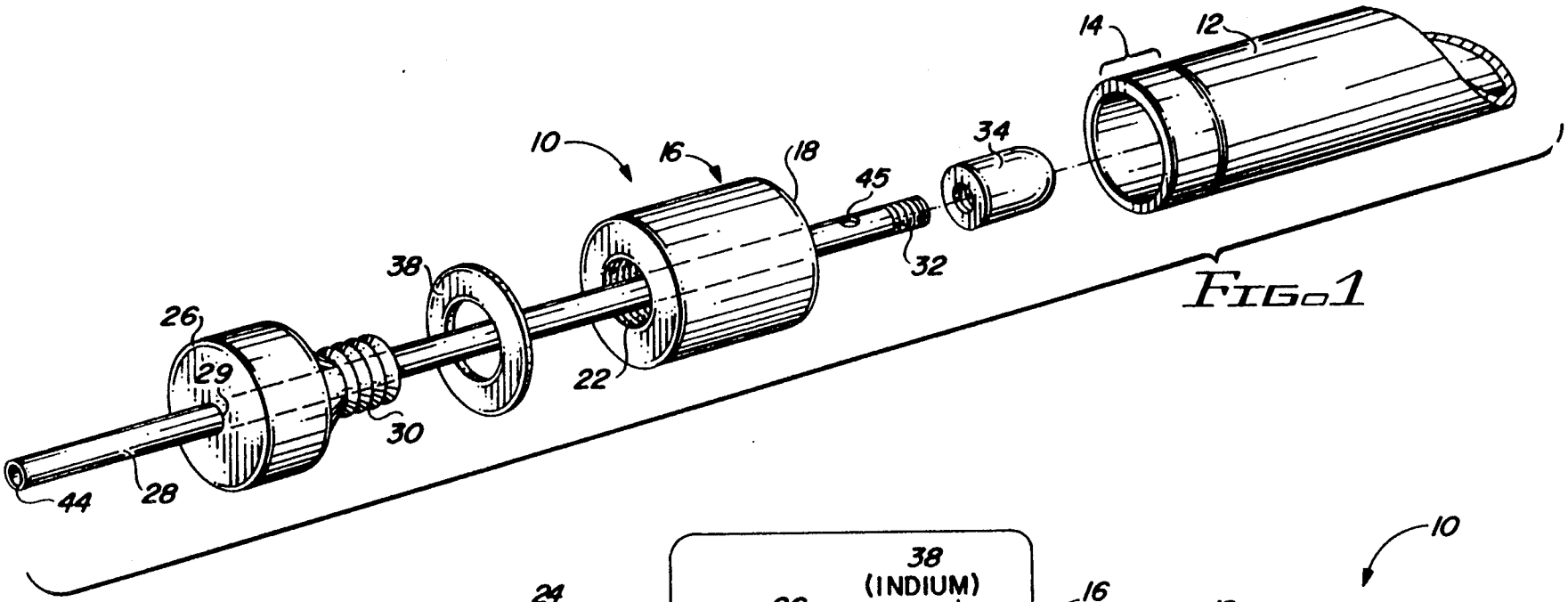
FIG. 1 is an exploded view of one end of a flashlamp made in accordance with the present invention.
Figure 2:
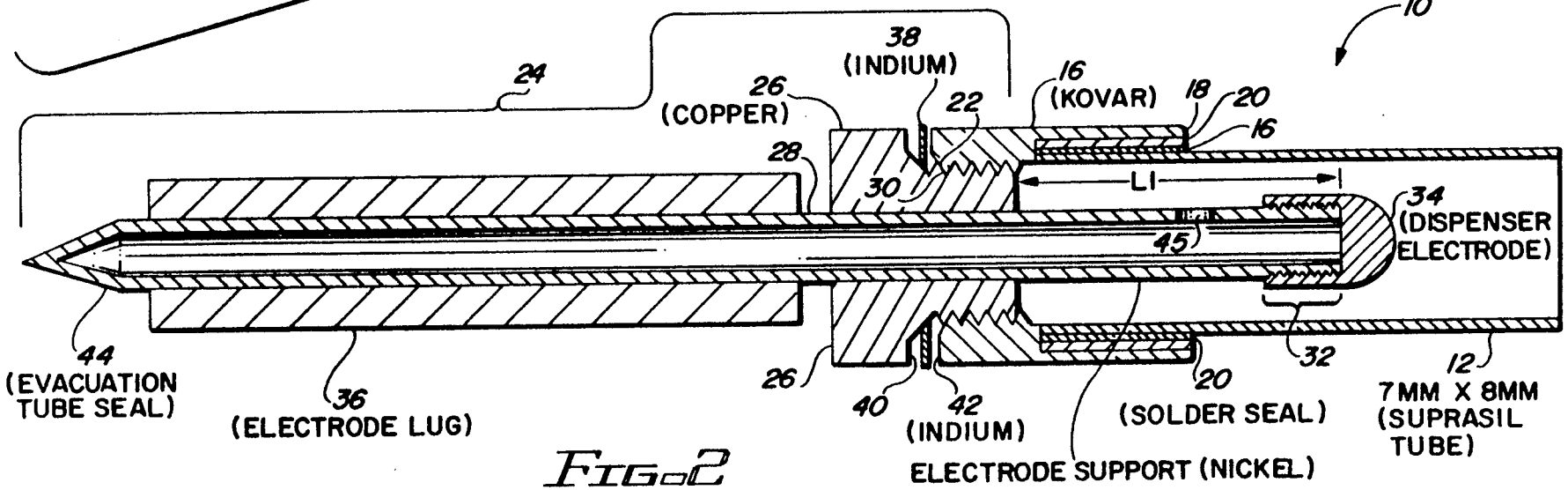
FIG. 2 is a side sectional view of one-half of the assembled flashlamp.

FIG. 1 is an exploded view of a flashlamp 10 made in accordance with the present invention. FIG. 2 is a side sectional view of one-half of the assembled flashlamp 10 of FIG. 1. The description of the flashlamp that follows is applicable to both figures, wherein like reference characters are used to refer to like elements.

The flashlamp includes a transparent tube 12, only one end of which is shown in FIG. 1 and FIG. 2. In a preferred embodiment, the transparent tube 12 is made from quartz, e.g., Suprasil (a type of quartz). Other types of transparent materials may, of course, also be used for the tube 12. The tube 12 is a round tube, having a circular cross section. In one embodiment of the invention, for example, the tube 12 is realized from a Suprasil tube having an inner diameter of 7 mm and an outer diameter of 8 mm.

At each end of the tube 12 to which an electrode is to be attached, a platinum coating 14 is deposited or otherwise coated or plated to the tube. Such coating may be simply "painted" on the ends of the tube 12 using conventional application techniques. A preferred coating material and application technique is to prepare or procure a suitable mixture of platinic acid, apply such mixture to the ends of the tube to form a thin coating, e.g., a coating that is barely opaque, but still shiny, and heat the ends of the tube to remove all but the platinum. Such thin coating advantageously mimics the glass or quartz surface, yet is permanently bonded thereto, and provides a surface to which solder will adhere.

A preferred solution of platinic acid used to coat the ends of the tube 12 may be prepared as follows: Platinic acid ($H_2PtCl_6.6H_2O$) is formed by reacting 3 gm PtO in 20 cc of 6.25NHCl at just below the boiling point for approximately one hour or until the liquid volume is reduced to approximately 5 cc. This is cooled and liquid "decanted" from the sediment (using a syringe). The liquid is transferred to a clean vessel and heated to boiling. The liquid is removed from the heat and 3 gm of cane sugar is mixed in slowly. At this point the sugar reacts with the hot acid and starts to blacken with the release of some gas. When the sugar is completely dissolved, 5 cc of glycerin is added. After cooling, the solution is ready to apply to the glass tube in order to form the desired platinum coating.

An attachment ring 16 includes a sleeve 18 that fits over the end of the tube 12 coated with the platinum coating 14. The attachment ring 16 is secured to the platinum ring 16 using conventional solder 20, e.g., solder made from a tin-lead or indium-tin. A preferred type of solder is 50% indium and 50% tin. The presence of the platinum coating advantageously facilitates the use of solder to perform this seal and bonding operation. The solder provides a soft seal that helps ruggedize the flashlamp 10.

The attachment ring 16 is preferably made from nickel. Nickel is preferred because it doesn't corrode and doesn't require a precise fit. Nor does it require the same or similar expansion properties as does the quartz tube 12. That is, if the tube expands or contracts due to changes in temperature (caused primarily by the duty cycle at which the flashlamp operates), the nickel attachment ring 16 need not expand or contract by the same amount. Rather, the solder layer placed between the nickel and platinum coating takes up the slack, as required. However, for most applications of the flashlamp of the present invention, the flashlamp is water cooled, so there are no significant changes in temperature that occur. Other methods or materials similar to nickel could also be used, e.g., Kovar (an alloy made from iron, nickel and cobalt).

As seen in FIGS. 1 and 2, the attachment ring 16 includes threads 22 placed around the inside thereof at the end opposite the sleeve 18. These threads provide a means for detachably securing an electrode assembly 24 to the quartz tube 12, as explained more fully below.

The electrode assembly 24 comprises an end cap 26 having an electrode support 28 passing therethrough. Threads 30 are placed around one end of the end cap 26. The threads 30 match the threads 22, so that the end cap 26 may be screwed into or out of the attachment ring 26. In a preferred embodiment, the first and second threads 22 and 30 each have a pitch of ¼-28 UNF, and a height of 0.25 inch.

A hole 29 is drilled or machined through the center of the end cap 26. The electrode support 28 passes through this hole so as to protrude a distance L1 from the threaded end of the end cap 26, as shown in FIG. 2. A first end 32 of the electrode support 28 is threaded to receive an electrode 34. An electrode lug 36 is attached to the other end of the electrode support 28.

In a preferred embodiment, the electrode support 28 is made from nickel and the end cap 26 is also made from nickel. However, the end cap 26 could also be made from copper, or other suitable metals or metal alloys. The electrode support 28 is soldered to the end cap 26 to seal the hole 29 through which the electrode support passes. The electrode 34 is preferably realized using a tungsten dispenser cathode, comprising roughly 80% tungsten and 20% additives. The additives are typically oxides of barium, calcium, aluminum, strontium, or combinations thereof. A preferred tungsten dispenser cathode includes additives that comprise a combination of oxides of barium, calcium and aluminum. Such a tungsten dispenser cathode is available from SPECTRA-MAT, of Watsonville, Calif. Advantageously, the temperature coefficient of the electrode support 28 is sufficiently different from that of the electrode 34 to cause the threaded connection between the electrode support and the electrode to become tighter as the temperature increases. This action provides a tight and secure electrical and mechanical connection between the electrode and electrode support as the operating temperature of the flashlamp increases.

In operation, it is desirable to have the electrode just hot enough for the additives in the electrode to flow to the electrode surface to provide low work-function electron emission, as needed. If the electrode is too hot, the additives tend to splatter within the flashlamp, causing the quartz envelope to become clouded. If the electrode is too cold, the tungsten tends to sputter, causing tungsten deposits to appear on the inside of the quartz envelope. Hence, it is important that the electrode temperature be properly controlled in order to keep the inside of the quartz envelope clean, and thereby provide a longer useful life of the flashlamp. A preferred operating temperature range for this type of tungsten dispenser cathode electrode is about 900° C.

To provide a secure and tight vacuum seal between the end cap 26 and the attachment ring 16, a sealing washer 38, or equivalent, fits over the threads 30 of the end cap. This sealing washer 38 fits between fronting surfaces 40 and 42 of the end cap 26 and the attachment ring 16, respectively. The washer 38 is made from a relatively soft metallic material that forms and seals the space between the fronting surfaces of the end cap 26 and the attachment ring 16 as these components are screwed together. A preferred material for the washer 38 is indium. Advantageously, indium is a very soft metal that not only facilitates easy assembly of the flashlamp 10, but also readily forms to fill the voids that may exist between the end cap 26 and the attachment ring 16. If desired, rather than using an indium washer 38, a bead of indium may be placed (e.g., through first heating and then cooling) on the surface 40 of the end cap 26 and/or the surface 42 of the attachment ring 16. Then, as the end cap 26 is screwed into the attachment ring 16, the indium cold flows to fill all voids and makes a tight vacuum between the two parts. Excess indium that flows out of the joint, may be simply scraped off and discarded.

The electrode lug 36 provides a convenient means for making electrical contact with the electrode support 28 and electrode 34. In a preferred embodiment, the electrode lug is soldered to the electrode support 28. Other suitable attachment means adapted to provide a secure mechanical and electrical connection between the lug 36 and the electrode support 28 could also be used, e.g., a press fit.

As seen best in FIG. 2, the electrode support 28 comprises a hollow tube or pipe. A "fill hole" 44 is located near the end 32. The other end 44 of the support 28 (the end opposite the end 32) is left open until it is desired to inject a suitable gas into the quartz tube 12. When a gas is injected into the quartz tube 12, the electrode support 28 provides a convenient means for accomplishing such injection. The hollow support tube or pipe 28 is first used to evacuate the quartz tube 12 by connecting the open end 44 to a suitable vacuum pump, and then the desired gas is injected into the quartz tube 12. Once the injection is complete, the open end 44 is sealed, e.g., by crimping or pinching the support at the end 44, as shown in FIG. 2. The crimped end 44 is then dipped in solder to provide a more secure mechanical seal. Thus, e.g., if the crimped end 44 is inadvertently bumped, no leaks are developed.

It is noted that only one end of the flashlamp 10 is shown in FIGS. 1 and 2. In operation, an electrode assembly 24 is attached to both ends of the tube 12, thereby providing two electrodes within the tube 12 that are in contact with the gas. When an electrical potential of sufficient magnitude is developed between these two electrodes, the gas vapor ionizes and produces a flash of light.

A preferred gas for use in the flashlamp 10 is xenon. Other gases, known in the art, may also be used. In general, the particular gas used is selected to provide desired spectral qualities for the intended application of the flashlamp. For example, some wavelengths are particularly advantageous for use in biological sterilization, the curing of epoxies, and/or ultraviolet photolithography. A desired range of wavelengths may be efficiently obtained from the flashlamp by controlling the pressure of the gas within the quartz tube 12.

In accordance with the present invention, the operating temperature of the electrode (for a given flashlamp average power) is controlled by adjusting the length L1 and material used for the electrode support 28 within the tube 12. Hence, by setting L1 to a prescribed value as the flashlamp is manufactured and assembled, a desired operating average power may be run. The flashlamp may also be cooled, as desired, during operation using a conventional cooling system, e.g., a water cooling system.

Figure 3:
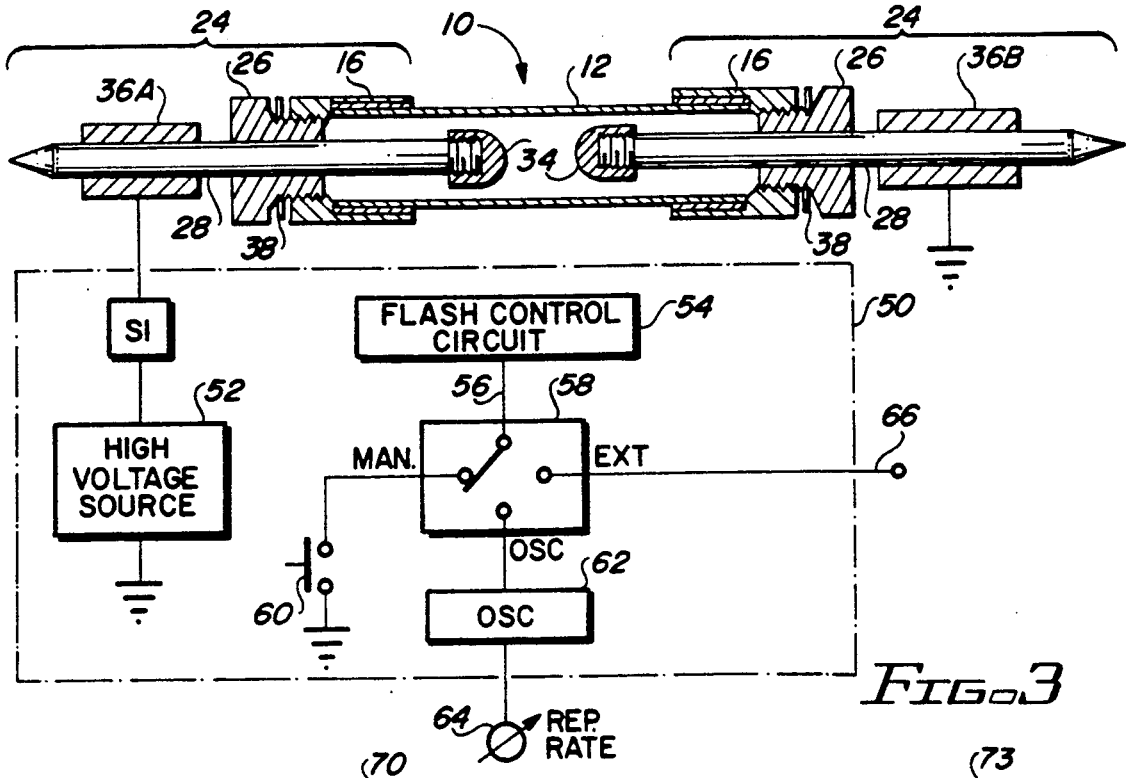
FIG. 3 is a block diagram of a flashlamp control circuit used to control one or more flashlamps.

Referring next to FIG. 3, a block diagram of one type of flashlamp control circuit 50 that may be used to control one or more flashlamps 10 is shown. The flashlamp 10 in FIG. 3 is the same as that described above in connection with FIGS. 1 and 2, and like reference numerals are used to identify like parts. The complete flashlamp 10 is shown in FIG. 3, including two electrode assemblies 24, one attached to each end of the flashlamp tube 12. The control circuit 50 includes a switch S1 that selectively connects a high voltage source 52 to a first electrode lug **36*a* of the flashlamp 10. A second electrode lug 36*b* is electrically connected to ground potential. A flash control circuit 54 controls the switch S1 in accordance with a drive signal 56. The drive signal 56, in turn, may be selectively obtained from a plurality of sources, as selected by switch 58. The switch 51 and the control circuit 50 are realized from conventional components, e.g., an SCR (silicon controlled rectifier) and appropriate SCR driving circuit. One setting of switch 58 allows the drive signal to be obtained from a manual ("MAN") source, e.g., a pushbutton 60. Another setting allows the drive signal to be obtained from an internal oscillator ("OSC") 62, having an adjustable frequency control 64. Still another setting allows the drive signal to be obtained from an external ("EXT") source 66**.

In operation, when switch 58 is the MAN position, the flashlamp 10 fires a single time each time that the pushbutton 60 is depressed. When the switch 58 is in the OSC position, the flashlamp 10 fires at a rate determined by the frequency of the oscillator 62, which frequency may be adjusted to any desired value by the adjustable frequency control 64. When the switch 58 is in the EXT position, the flashlamp 10 fires whenever an external trigger signal is applied to the external terminal 66. Thus, in the EXT position, a suitable external generator, e.g., realized with a computer, or other processing circuit, may generate a trigger signal at any appropriate time. For some applications, e.g., biological sterilization, a temperature sensor may be affixed to or near the flashlamp 10, and an external generator may be configured to trigger the flashlamp as required in order to maintain the operating temperature at a desired level. Maintaining the desired temperature within the flashlamp not only helps to assure a long operating life, but for some applications also helps to set the pressure within the flashlamp to a desired operating point, or range.

One of the significant features provided by the flashlamp described herein is its longer life. By avoiding the use of brazing, or similar bonding techniques that introduce impurities or contaminants at the electrode, the flashlamp is able to operate contaminant-free, thereby avoiding clouding within the quartz tube, or deposits on the quartz tube, either one of which conditions shortens the useful life of the lamp. As previously indicated, the electrode 34 is attached to the electrode support 28 by simply screwing the electrode onto the support. No impurities or contaminants of any kind are introduced. If more than the screw attachment is required in order to make a good electrical connection, the electrode 34, e.g., may be arc welded to the electrode support 28. However, for most applications, the mechanical screw-on connection of the electrode to the support provides a sufficiently good electrical connection to provide a long operating life of the flashlamp. Moreover, the simple mechanical assembly facilitates tee use of an automated assembly, which assembly may be carried out at reduced cost.

A further feature of the invention is the ability to design the flashlamp to handle a wide range of average powers (approximately two orders of magnitude) by simply varying the length of the electrode support (distance L1 in FIG. 2) and by choosing among materials of different thermal conductivity for construction of the electrode support. The electrode support, for example, may be made from nickel, copper, or titanium, or alloys of nickel, copper or titanium. The electrode may be realized from tungsten and various oxides, as previously described. For example, assuming an overall envelope size of approximately 7 mm internal diameter by 20 cm arc length (distance between electrodes), an electrode support (L1) length of 1 cm (nickel) provides an average lamp power of 6 kilowatts (KW). Changing L1 to 5 mm, allows the average lamp power to change to 12 KW.

Another significant feature provided by the flashlamp described herein is the ease with which the flashlamp may be assembled. The steps associated with assembling a flashlamp 10 are summarized in the flow chart shown in FIG. 4. (In the description of FIG. 4 below, the various steps of the assembly method are referred to as "blocks", with each block having a reference number associated therewith. The component parts of the flashlamp are referred to by the same reference numbers as are used in FIGS. 1-3.)

Figure 4:
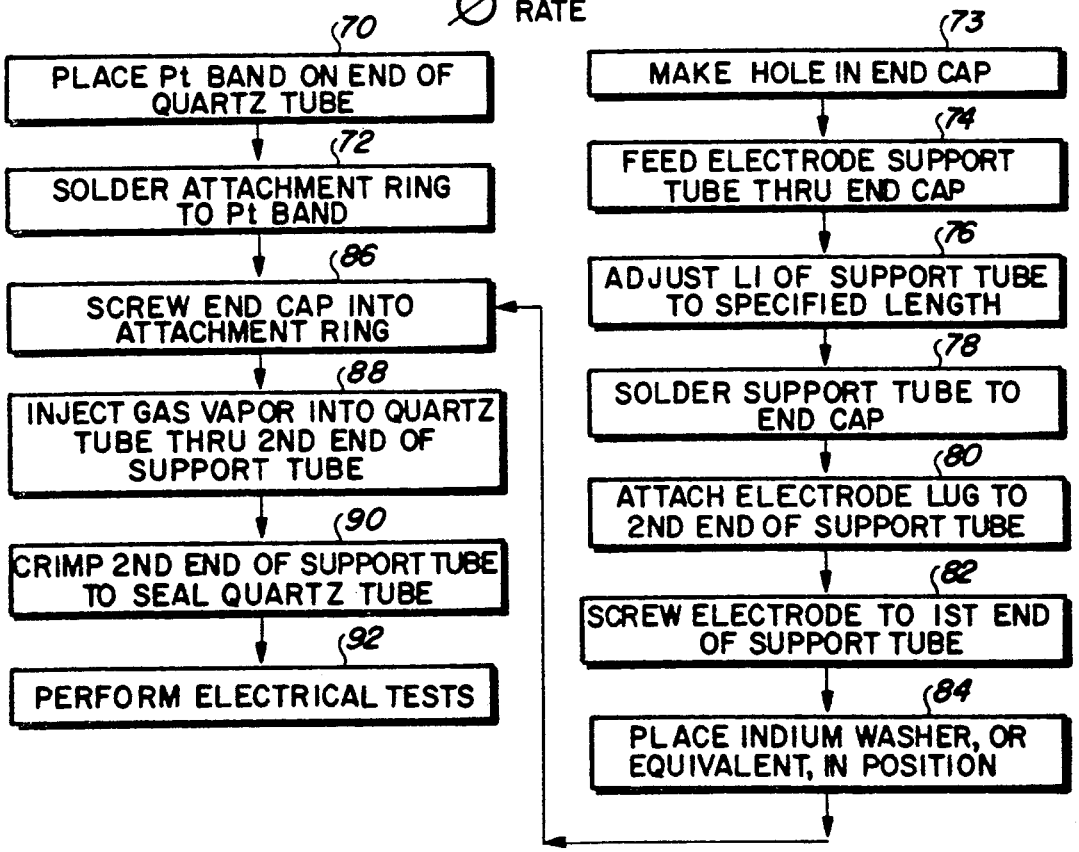
FIG. 4 is a flow chart illustrating the manner of assembling the flashlamp of the present invention.
Figure 1:
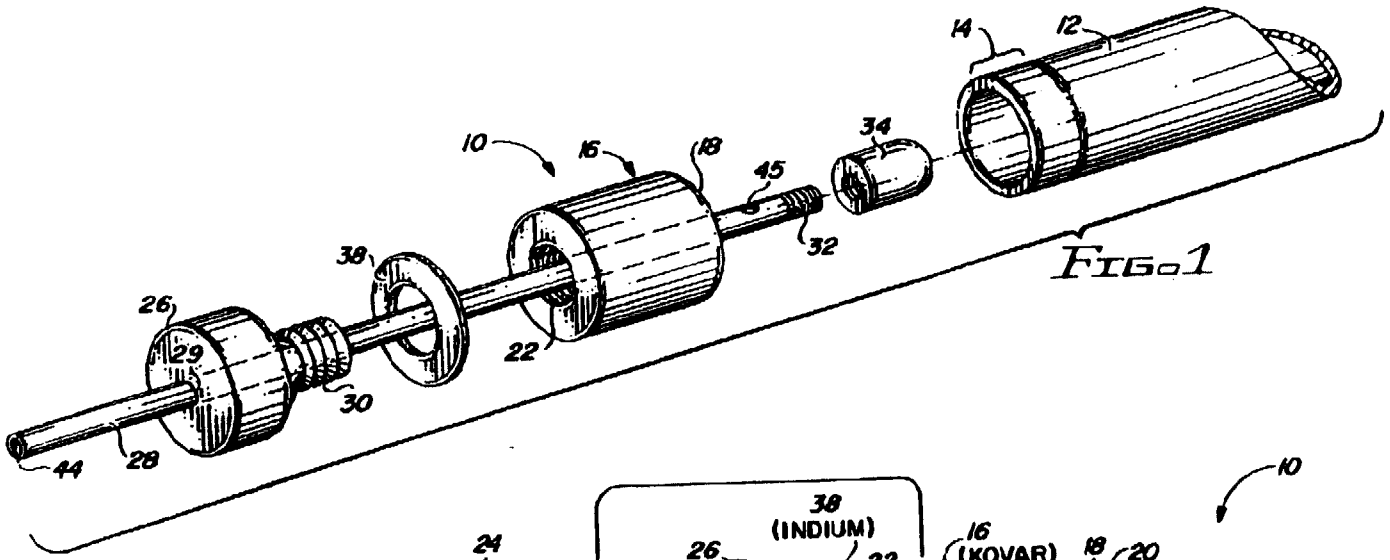
Figure 2:
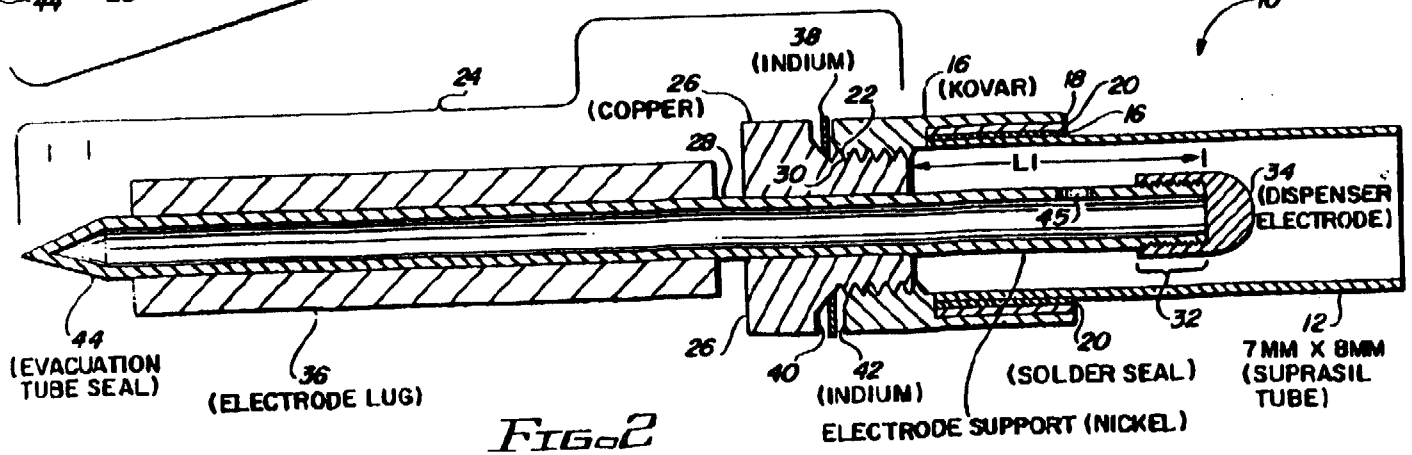

As seen in FIG. 4, two parallel paths may be followed to assemble the two main components of the flashlamp, an electrode assembly 24 and a tube assembly (comprising the tube 12 having the attachment ring 16 secured to its ends). The tube assembly is assembled by first placing the platinum coating or plating 14 on each end of the quartz tube 12 (block 70 of FIG. 4). Then, the sleeve 18 of the attachment ring 16 is soldered to the platinum coating 14 in conventional manner (block 72).

The electrode assembly is assembled by first making the hole 29 through the end cap 26 (block 73). The electrode support tube 28 is then inserted through the hole (block 74) and the length of the threaded end 32 from the end cap (distance L1) is adjusted to a desired length (block 76). The support tube 82 is then soldered to the end cap 26 so as to seal the hole 29 (block 78). The electrode lug 36 is attached to the support tube 28 near end 44 of the support tube (block 80), and the electrode 34 is screwed onto the threaded end 32 of the support tube. If not already present, the fill hole 45 is drilled or punched in the support tube 28 near the electrode end 32. The indium sealing washer 38, or equivalent, is then placed between the surfaces 40 and 42 of the end cap 26 and the attachment ring 16, respectively (block 84).

The electrode assembly is attached to the tube assembly by screwing the electrode assembly 24 into the attachment ring 26 of the tube assembly (block 86 of FIG. 4), thereby sealing the two assemblies together. A gas, e.g., xenon, is then injected into the tube assembly through the open end 44 of the electrode support 28 (block 88). This step typically involves first evacuating the tube 12 through the open end of the support 28 using a suitable vacuum pump. The desired amount of gas is then injected into the tube 12, and the end 44 of the electrode support is sealed, e.g, by crimping or pinching using a suitable hydraulic crimper (block 90). The crimped end is then dipped in solder. Finally, electrical and other tests are performed (block 92) in order to assure that the resulting flashlamp has the desired mechanical, electrical, and optical characteristics.

Advantageously, the flashlamp described herein provides a convenient and effective technique for controlling the temperature within the flashlamp. In addition to selectively setting the length L1 to a desired length, the thickness of the quartz tube is selected to provide an appropriate temperature on the inside surface of the quartz tube.

As thus described, it is seen that the present invention provides an improved flashlamp that is easy to manufacture, rugged in construction, and efficient to operate, being capable of operating at high average power over a long life. Advantageously, elimination of contaminants by avoiding brazing or similar contaminant-producing techniques, assures a long service life. Further, the simplified mechanical assembly provides a flashlamp that can be easily manufactured, and even disassembled and serviced, e.g., cleaned, after initial assembly, if desired. However, the flashlamp is sufficiently inexpensive to manufacture so as to make it cost effective to simply discard some of the flashlamp components after the flashlamp's normal service life, and refurbish and recycle other component parts. Advantageously, the service life of the flashlamp herein described may be up to ten times longer than conventional flashlamps.

While the invention herein disclosed has been described by means of specific embodiments and applications thereof, numerous modifications and variations could be made thereto by those skilled in the art without departing from the scope of the invention set forth in the claims.

What is claimed is:

1. A flashlamp comprising:

a transparent tube having first and second open ends;

first and second electrode assemblies detachably secured to said first and second open ends, respectively, each of said first and second electrode assemblies including:

an end cap, a rigid electrode support attached to said end cap, said electrode support comprising an electrically conductive material, said electrode support passing through said end cap such that a first end protrudes from one side of said end cap, and a second end protrudes from the other side of said end cap, and an electrode detachably secured to the first end of the electrode support, said electrode and electrode support being detachably secured in a manner that introduces no impurities at the electrode;

attachment means for detachably sealing said first and second electrode assemblies to the first and second open ends of said transparent tube, respectively, such that the electrode of each electrode assembly is inside of said transparent tube, and the second end of said electrode support is outside of said transparent tube;

a prescribed gas inside of said transparent tube; and means for making electrical contact with the second end of said electrode support of said first and second electrode assemblies, whereby an electrical potential may be established between said electrodes of said first and second electrode assemblies sufficient to ionize said gas within said transparent tube and cause a flash of light to be emitted therefrom.

2. The flashlamp as set forth in claim 1 wherein said attachment means comprises:

an attachment ring affixed to said first and second open ends of said transparent tube, said attachment ring having a first engagement means thereon; and second engagement means affixed to said end cap of each of said first and second electrode assemblies for selectively attaching to said first engagement means;

whereby said end cap may be selectively attached to said attachment ring, thereby detachably securing said electrode assembly to said transparent tube.

3. The flashlamp as set forth in claim 2 wherein said first and second engagement means comprise respective sets of threads placed around engaging members of said attachment ring and said end cap, whereby said electrode assembly is secured to said transparent tube by threading said end cap into engagement with said attachment ring.

4. The flashlamp as set forth in claim 3 further including a soft metal between said engaging members of said attachment ring and said end cap.

5. The flashlamp as set forth in claim 4 wherein said soft metal comprises indium.

6. The flashlamp as set forth in claim 4 further including a metallic coating placed around the first and second ends of said transparent tube, said metallic coating facilitating the attachment of said attachment ring to said transparent tube.

7. The flashlamp as set forth in claim 6 wherein said transparent tube comprises a glass tube, and said metallic coating comprises a platinum coating, and further wherein said attachment ring is secured to said platinum coating with solder.

8. The flashlamp as set forth in claim 5 wherein said rigid electrode support is made from a first material having a first temperature coefficient, and said electrode is made from a second material having a second temperature coefficient, said second temperature coefficient being different than said first temperature coefficient, said first and second temperature coefficients being selected to cause said first and second materials to bond more tightly against each other at higher temperatures.

9. The flashlamp as set forth in claim 8 wherein said first and second materials comprise nickel.

10. The flashlamp as set forth in claim 4 wherein said rigid electrode support comprises a metallic tube, said metallic tube having a fill hole near its first end to facilitate filling said transparent tube with said prescribed gas.

11. The flashlamp as set forth in claim 10 wherein said metallic tube from which the rigid electrode support is made is selected from the group of metals or

12. A flashlamp comprising:

a quartz envelope having a gas sealed therein;

electrode means detachably secured to said quartz envelope for making electrical contact with said gas vapor, said electrode means including a pair of spaced apart electrodes inside of said quartz envelope, each electrode of the pair of electrodes being detachably connected to a first end of a respective electrode support in a manner that introduces no impurities at the electrode; and means for making electrical contact with said electrode means from a location external to said quartz envelope.

13. The flashlamp as set forth in claim 12 wherein said quartz envelope is detachably secured to a metallic cap, said electrode support being affixed to said metallic cap.

14. The flashlamp as set forth in claim 13 wherein said electrode support includes a first end that protrudes from a first side of said metallic cap into said quartz envelope, and a second end that protrudes from a second side of said metallic cap away from said quartz envelope.

15. The flashlamp as set forth in claim 14 further including an attachment ring secured and sealed to said quartz envelope, said attachment ring including means for detachably engaging said metallic cap.

16. The flashlamp as set forth in claim 15 further including a platinum coating placed around said quartz envelope at the location where said attachment ring is secured thereto.

17. The flashlamp as set forth in claim 14 wherein said electrode and said electrode support at said first end include matching threads, said electrode being threadably secured to the first end of said electrode support.

18. The flashlamp as set forth in claim 14 wherein said electrode support comprises a hollow, metallic tube that passes through said metallic cap, a fill hole being located near the first end of said electrode support to facilitate insertion of said gas into said quartz envelope.

19. A method of assembling a flashlamp comprising:

(a) placing a platinum coating on an end of a quartz tube that is to be sealed;

(b) soldering an attachment ring to said platinum coating, said attachment ring having threads for receiving a threaded end cap;

(c) assembling an electrode assembly, said electrode assembly including a hollow electrode support secured to and passing through said end cap;

(d) screwing said electrode assembly into said attachment ring;

(e) injecting a gas into said quartz tube through said hollow electrode support; and (f) crimping an end of said electrode support external to said quartz tube, thereby sealing said gas within said quartz tube.

20. The method of assembling a flashlamp as set forth in claim 19 wherein step (c) comprises:

(c1) forming a hole through the center of said end cap;

(c2) inserting said electrode support through the hole of said end cap so that it protrudes from both sides thereof, the length of said electrode support from the end cap to a first end comprising a prescribed distance;

(c3) soldering said electrode support within the hole of said end cap so that said hole is sealed; and (c4) detachably attaching an electrode to the first end of said electrode support.

21. The method of assembling a flashlamp as set forth in claim 20 further including forming a fill hole near the end of said electrode support to which said electrode is attached in step (c4).

22. The method of assembling a flashlamp as set forth in claim 20 wherein said electrode support is threaded to receive said electrode on the end of the electrode support that is on the electrode side of said end cap, and wherein step (c4) comprises threading said electrode onto said electrode support.

23. The method of assembling a flashlamp as set forth in claim 20 wherein step (d) includes inserting a soft metal between said attachment ring and said threaded end cap prior to screwing said threaded end cap into said attachment ring.

* * * * *

UNITED STATES PATENT AND TRADEMARK OFFICE

CERTIFICATE OF CORRECTION

PATENT NO. : 5,126,621

DATED : June 30, 1992

INVENTOR(S) : Morton, et al.

It is certified that error appears in the above-indentified patent and that said Letters Patent is hereby corrected as shown below:

Column 5, line 28, change "($H_2PtCl_6.6H_2O$)" to --(($H_2PtCl_6 \cdot H_2O$)--. Column 5, line 44, change "platinum ring 16" to --platinum coating 14--. Column 6, line 9, change "26" to --16--. Column 8, line 6, change "36a" to --36A--. Column 8, line 7, change "36b" to --36B--. Column 8, line 12, change "51" to --61--. Column 8, line 62, change "facilitatee" to --facilitates--. Column 9, line 38, change "82" to --28--. Column 9, line 50, change "26" to --16--. Column 11, line 48, after "metals or" insert --alloys comprising nickel, copper, titanium, or alloys containing nickel, copper or titanium.--.

IN THE DRAWINGS

Delete Drawing Sheet 1, and substitute therefor the Drawing Sheet consisting of FIGS. 1-2, as shown on the attached page.

Signed and Sealed this

Twenty-first Day of November, 1995

Attest:

Bruce Lehman

BRUCE LEHMAN

Attesting Officer

Commissioner of Patents and Trademarks